US011699870B2

(12) United States Patent
Meixner et al.

(10) Patent No.: US 11,699,870 B2
(45) **Date of Patent: *Jul. 11, 2023**

(54) SPRING CONTACT ON A RECHARGEABLE BATTERY

(71) Applicant: Hilti Aktiengesellschaft

(72) Inventors: Ralf Meixner, Germaringen (DE); Johannes Stempfhuber, Utting am Ammersee (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

This patent is subject to a terminal disclaimer.

(21) Appl. No.: 17/680,083

(22) Filed: Feb. 24, 2022

(65) Prior Publication Data

US 2022/0181813 A1 Jun. 9, 2022

Related U.S. Application Data

(63) Continuation of application No. 16/606,512, filed as application No. PCT/EP2018/059656 on Apr. 16, 2018, now Pat. No. 11,289,842.

(30) Foreign Application Priority Data

Apr. 21, 2017 (EP) ..... 17167447

(51) Int. Cl.
*H01R 24/00* (2011.01)
*H01R 13/15* (2006.01)
(Continued)

(52) U.S. Cl.
CPC ..... *H01R 13/15* (2013.01); *B25F 5/02* (2013.01); *H01R 13/112* (2013.01); *H01R 24/68* (2013.01); *H01R 2103/00* (2013.01)

(58) Field of Classification Search
CPC ..... H01R 13/6275; H01R 13/6392; H01R 13/6395; H01R 13/631; H01R 13/15;
(Continued)

(56) References Cited

U.S. PATENT DOCUMENTS 3,786,392 A * 1/1974 McDaniel ..... H01R 13/652 439/103
3,890,030 A 6/1975 McDaniel et al.
(Continued)

FOREIGN PATENT DOCUMENTS

CN 1138513 A 12/1996
CN 1229377 A 9/1999
(Continued)

*Primary Examiner* — Thanh T Le
(74) *Attorney, Agent, or Firm* — Davidson, Davidson & Kappel, LLC

(57) ABSTRACT

A power tool, which includes a receiving device having at least one receiving element and a power supply unit connectable to the power tool, for example a rechargeable battery, which includes a connecting device, the connecting device having at least one contact element, the receiving device being designed to receive and hold the connecting device, so that the at least one receiving element and the at least one contact element are connectable to each other for establishing an electrical connection. A damping element is provided on at least one contact element, whereby the at least one contact element is movable in a first direction and a second direction as well as relative to the particular receiving element, so that it is possible to counteract a relative movement between the contact element and the particular receiving element when the contact element and the receiving element are connected to each other.

20 Claims, 4 Drawing Sheets

(51) Int. Cl.

| | |
|---|---|
| ***B25F 5/02*** | (2006.01) |
| ***H01R 13/11*** | (2006.01) |
| *H01R 24/68* | (2011.01) |
| *H01R 103/00* | (2006.01) |

(58) Field of Classification Search
CPC ..... H01R 13/112; H01R 24/68; B25F 5/001; B25F 5/02; Y02E 60/12; H02J 7/0024
See application file for complete search history.

(56) References Cited

U.S. PATENT DOCUMENTS

| | | | | |
|---|---|---|---|---|
| 3,952,239 | A * | 4/1976 | Owings | H01M 50/20 173/171 |
| 3,999,110 | A | 12/1976 | Ramstram et al. | |
| 4,684,192 | A * | 8/1987 | Long | H01R 13/629 439/350 |
| 5,030,902 | A * | 7/1991 | Matti | B26B 19/286 30/DIG. 1 |
| 5,044,977 | A * | 9/1991 | Vindigni | H01R 13/629 439/345 |
| 5,248,264 | A * | 9/1993 | Long | H01R 13/62 439/929 |
| 5,480,318 | A * | 1/1996 | Garrison | H01R 24/30 439/346 |
| 5,746,617 | A | 5/1998 | Porter et al. | |
| 5,881,823 | A | 3/1999 | Glauning et al. | |
| 6,065,988 | A | 5/2000 | Kubota et al. | |
| 6,199,640 | B1 | 3/2001 | Hecht | |
| 6,304,058 | B2 | 10/2001 | Watson et al. | |
| 6,313,604 | B1 | 11/2001 | Chen et al. | |
| 6,376,942 | B1 * | 4/2002 | Burger | B25F 5/02 429/97 |
| 6,443,753 | B1 * | 9/2002 | Bludis | H01R 13/639 439/484 |
| 6,696,817 | B2 | 2/2004 | Awatsu et al. | |
| 6,712,637 | B2 | 3/2004 | Rosa et al. | |
| 6,729,413 | B2 * | 5/2004 | Turner | H01M 50/247 173/217 |
| 6,773,283 | B2 | 8/2004 | Yoshimatsu et al. | |
| 7,243,734 | B2 | 7/2007 | Nanjing et al. | |
| 7,452,230 | B1 | 11/2008 | Miller et al. | |
| 7,479,760 | B2 | 1/2009 | Chang et al. | |
| 7,659,694 | B2 * | 2/2010 | Griffin | H01M 50/244 320/112 |
| 7,719,229 | B2 | 5/2010 | Kaneko et al. | |
| 7,922,529 | B1 | 4/2011 | Meurer et al. | |
| 8,113,868 | B2 | 2/2012 | Glauning et al. | |
| 8,152,554 | B2 | 4/2012 | Chapel et al. | |
| 8,312,937 | B2 * | 11/2012 | Turner | H01M 50/204 173/217 |
| 8,389,143 | B2 | 3/2013 | Robetakamp et al. | |
| 8,715,018 | B2 | 5/2014 | Yoshikawa et al. | |
| 8,981,719 | B2 | 3/2015 | Inoue et al. | |
| 9,496,648 | B1 | 11/2016 | Hu et al. | |
| 9,905,966 | B2 * | 2/2018 | Burger | H01R 13/631 |
| 10,797,622 | B2 * | 10/2020 | Hikawa | H02P 6/08 |
| 11,173,551 | B2 * | 11/2021 | Meixner | B23B 45/02 |
| 11,207,765 | B2 * | 12/2021 | Beckman | B25B 23/147 |
| 11,289,842 | B2 * | 3/2022 | Meixner | H01R 13/112 |
| 11,381,012 | B2 * | 7/2022 | Wang | H01R 13/2421 |

FOREIGN PATENT DOCUMENTS

| | | | |
|---|---|---|---|
| CN | 1857873 | A | 11/2006 |
| CN | 103151634 | A | 6/2013 |
| EP | 1036636 | A1 | 9/2000 |
| EP | 2602880 | | 6/2013 |
| GB | 2425899 | | 11/2006 |
| WO | WO2013/186045 | A1 | 12/2013 |

* cited by examiner

SPRING CONTACT ON A RECHARGEABLE BATTERY

This is a Continuation of U.S. Ser. No. 16/606,512, filed on Dec. 3, 2019, now published as U.S. 2020/0153142 A1 on May 14, 2020, which is a National Phase Application of PCT/EP2018/059656, filed on Apr. 16, 2018, which claims priority to EP 17167447.6, filed Apr. 21, 2017. All of the above applications are hereby incorporated by reference herein.

The present invention relates to a power tool, which includes a receiving device having at least one receiving element and a power supply unit connectable to the power tool, for example a rechargeable battery, which includes a connecting device, the connecting device having at least one contact element, the receiving device being designed to receive and hold the connecting device, so that the at least one receiving element and the at least one contact element are connectable to each other for establishing an electrical connection.

BACKGROUND OF THE INVENTION

Cordless power tools may be operated with the aid of a rechargeable battery for power supply purposes. The rechargeable battery may be removed from the power tool to be able to recharge it with electrical current in a charging device.

In an assembled state, i.e. when the power tool and the rechargeable battery are connected to each other, the transmission of the electrical current from the rechargeable battery to the power tool takes place with the aid of electrical contact partners. The contact partners are each made up of a first and a second contact element, which are connectable to each other. The first electrical contact element is situated on the rechargeable battery, and the second contact element is situated on the power tool. The second contact element is usually inserted into the first contact element. The second contact element may also be referred to as a receiving element, since it is suitable, among other things, for receiving the electrical current for the power tool.

During the operation of the power tool, a high mechanical load in the form of acceleration forces may act upon the electrical contact elements, due to application-induced vibrations or oscillations. In addition to this mechanical load, an electrical load in the form of electrical current may also take effect.

This mechanical load may result in relative movements between the contact elements on the power tool and battery sides, which cause wear on the contact elements. Depending on the application of the power tool, this wear may be additionally amplified by an introduction of dust between the contact elements. Due to the vibration-induced relative movement between the contact elements as well as due to a wear-induced increase in the contact resistance of the contact elements, a thermal overload of the contact elements may occur, which may even result in a burn-off of the contact elements.

SUMMARY OF THE INVENTION

It is an object of the present invention to provide a power tool having improved contact elements, in which a wear and, in particular the risk of a burn-off of the contact elements, is reduced.

The present invention provides a power tool, which includes a receiving device having at least one receiving element and a power supply unit connectable to the power tool, for example a rechargeable battery, which includes a connecting device, the connecting device having at least one contact element, the receiving device being designed to receive and hold the connecting device, so that the at least one receiving element and the at least one contact element are connectable to each other for establishing an electrical connection.

A damping element is provided on at least one contact element, whereby the at least one contact element is movable in a first direction and a second direction as well as relative to the particular receiving element, so that it is possible to counteract a relative movement between the contact element and the particular receiving element when the contact element and the receiving element are connected to each other.

A relative movement between the contact element and the receiving element may be reduced hereby, thus making it possible to counteract the vibration-induced wear on the contact element and the receiving element.

According to one advantageous specific embodiment of the present invention, it may be provided that the damping element is designed as a spring and is positioned behind the contact element in the first direction, so that a spring force applied by the damping element designed as a spring presses the contact element in the second direction. In particular, the maximum freedom of movement of the contact element relative to the receiving element may be effectively counteracted hereby.

According to an alternative specific embodiment, however, it is also possible for the damping element to be designed as a component including an elastically deformable material. An elastomer or any other suitable dimensionally stable yet elastically deformable plastic is possible as the material.

This makes it possible to easily counteract a vibration-induced movement of the contact element in multiple directions, i.e. not only in the direction of or against the direction of the receiving element.

BRIEF DESCRIPTION OF THE DRAWINGS

Other advantages result from the following description of the figures. The figures illustrate different exemplary embodiments of the present invention. The figures, the description and the claims contain numerous features in combination. Those skilled in the art will advantageously also consider the features individually and combine them to form other meaningful combinations.

DETAILED DESCRIPTION

Figure 1:
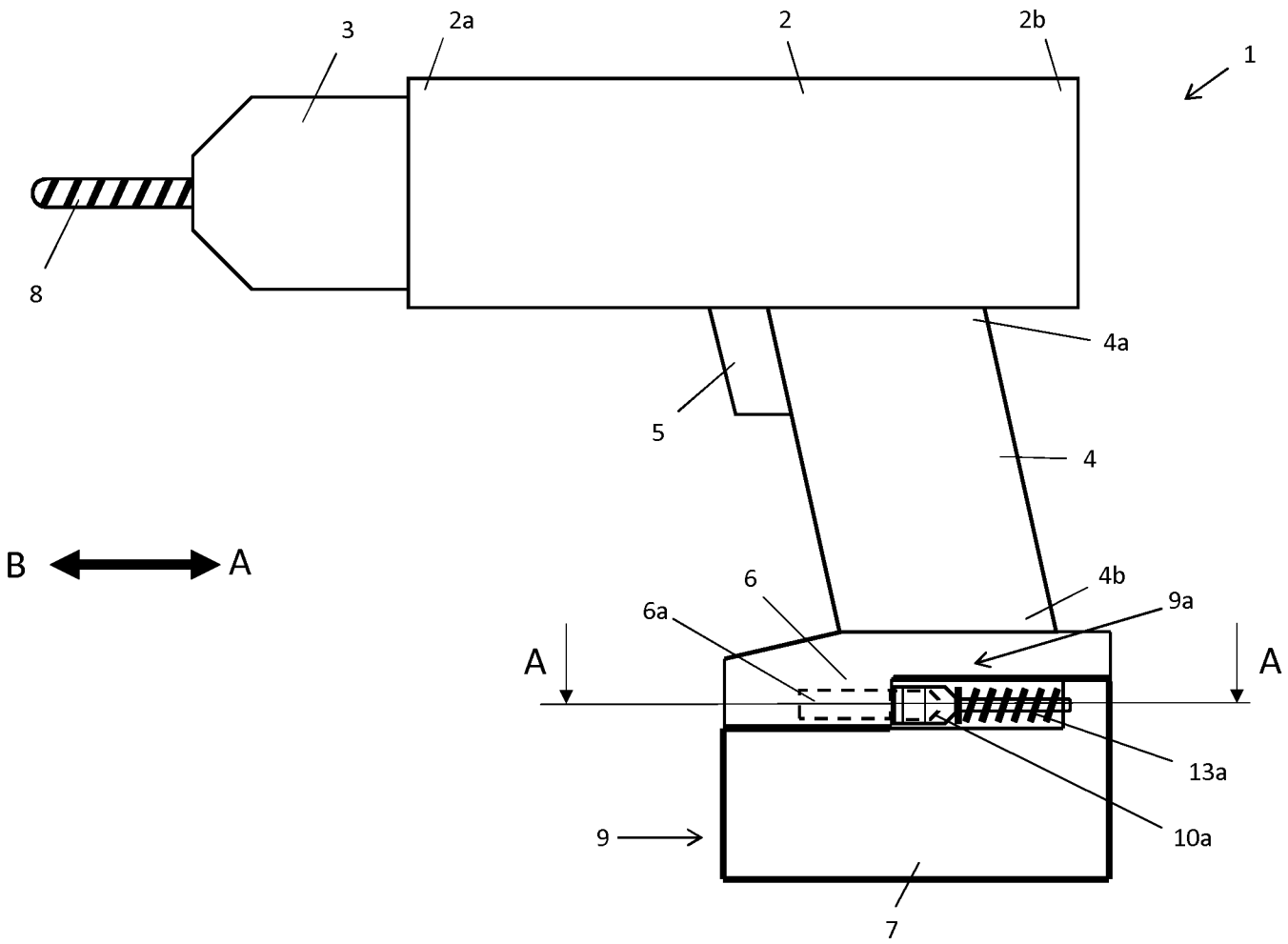
FIG. 1 shows a side view of a power tool according to the present invention, including a rechargeable battery connected to the power tool.
Figure 2:
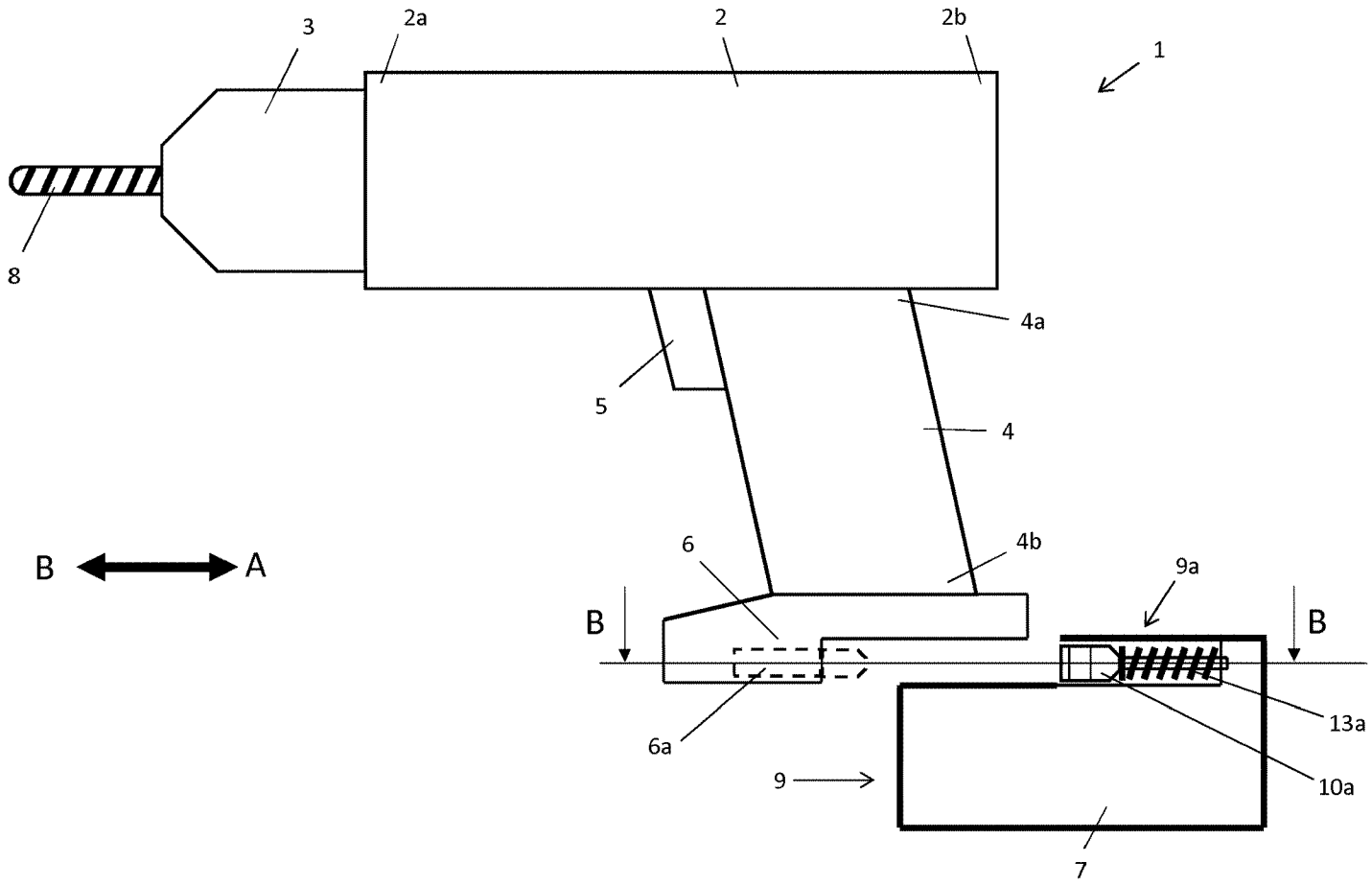
FIG. 2 shows another side view of a power tool according to the present invention, including a rechargeable battery removed from the power tool.

An example of a specific embodiment of power tool 1 according to the present invention is illustrated in FIGS. 1 and 2.

Power tool 1 is designed in the form of a power drill. However, it is also possible for power tool 1 to be a hammer drill, a circular saw or the like.

Power tool 1 illustrated in FIGS. 1 and 2 essentially includes a housing 2, a tool holder 3 and a handle 4, which has an activation switch 5. In addition, power tool 1 includes a receiving device 6 for a power supply unit 7. As illustrated in FIGS. 1 through 4, power supply unit 7 is designed as a rechargeable battery, also referred to as a battery.

According to another specific embodiment of the present invention (not illustrated in the figures), power supply unit 7 may also be designed as a connecting unit having a power cord for connection to a power network.

FIG. 1 shows a state in which power supply unit 7 designed as a battery is connected to power tool 1. For this purpose, battery 7 is pushed onto receiving device 6 in arrow direction B. As illustrated in FIG. 2, battery 7 may be removed again from receiving device 6, and thus from power tool 1, according to arrow direction A (and against arrow direction B). Power supply unit 7 is held on power tool 1 by a locking device, which is not illustrated.

Housing 2 has a first end 2*a* and a second end 2*b*. Tool holder 3 is positioned on a first end 2*a* of housing 2. Tool holder 3 is used to receive and detachably hold a tool 8. Tool 8 illustrated in FIGS. 1 and 2 is designed in the form of a drill.

Handle 4 has activation switch 5, a first end 4*a* and a second end 4*b*. Activation switch 5 is used to actuate power tool 1. First end 4*a* of handle 4 is fastened to a second end 2*b* of the housing and below housing 2.

Receiving device 6 for power supply unit 7 designed as a battery is positioned on second end 4*b* of handle 4.

Figure 3:
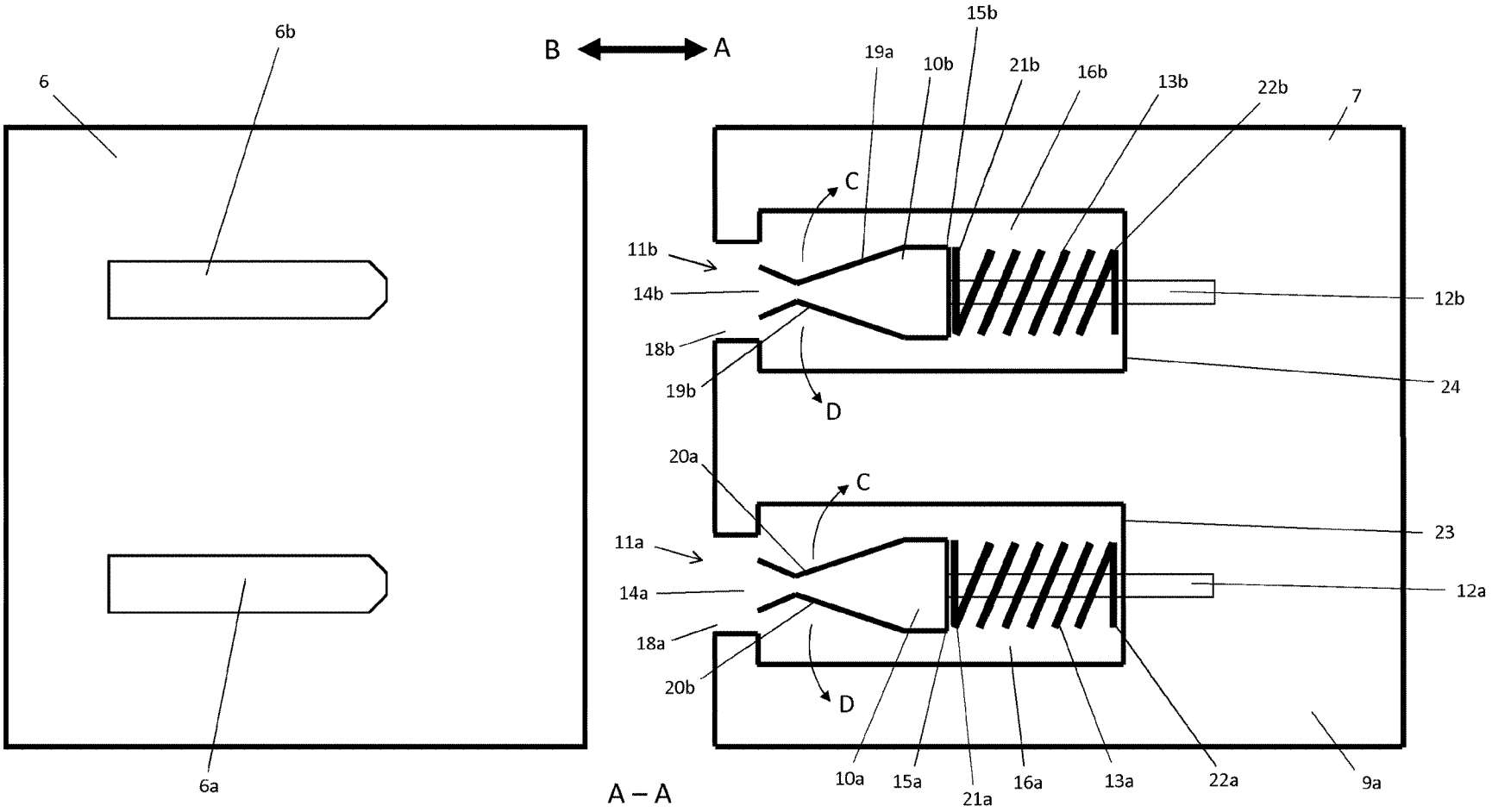
FIG. 3 shows a sectional view along section line A-A in FIG. 1, the rechargeable battery and the power tool being separated from each other.
Figure 4:
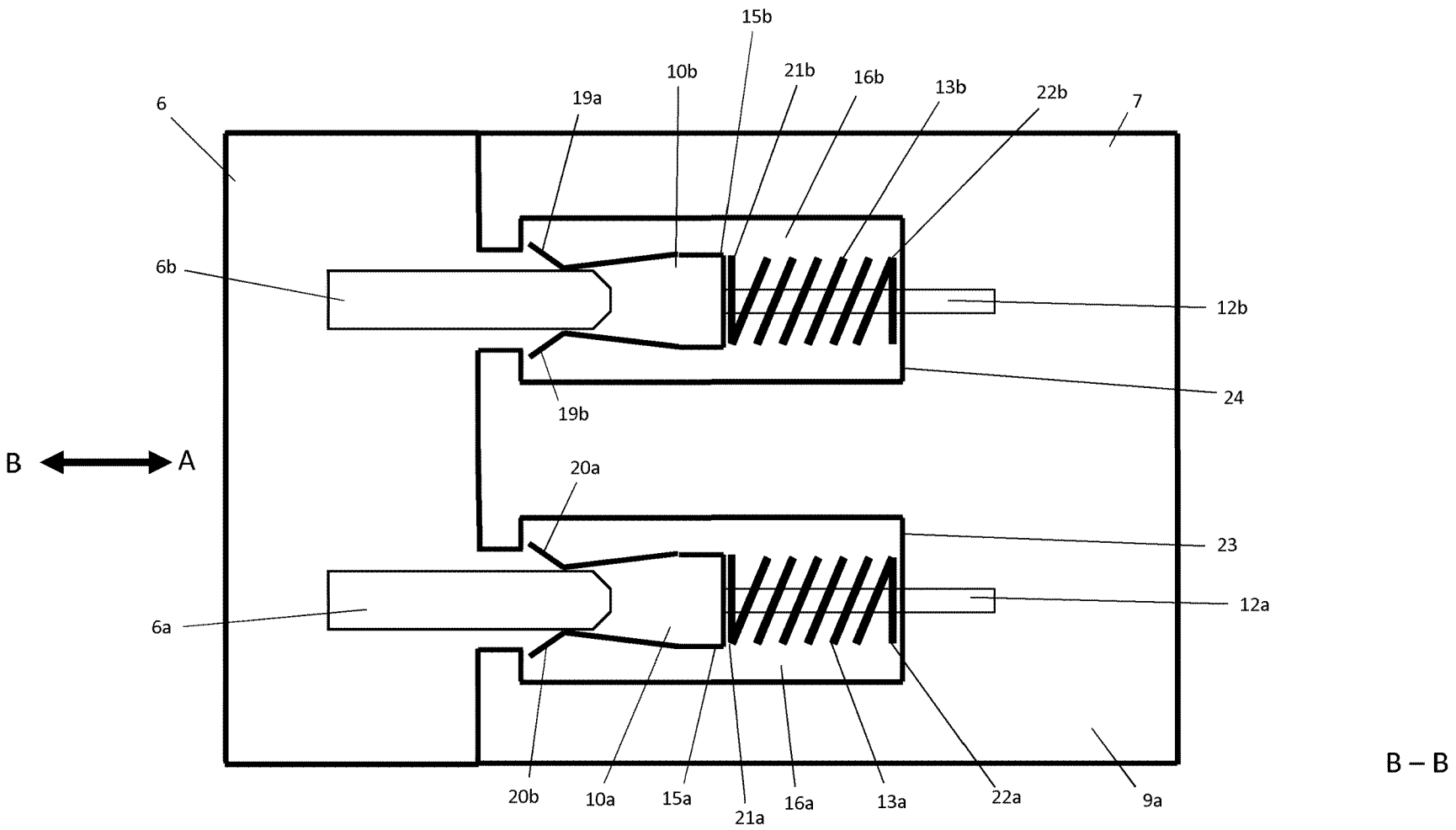
FIG. 4 shows a sectional view along section line B-B in FIG. 2, the rechargeable battery and the power tool being connected to each other.

As illustrated in FIGS. 3 and 4, receiving device 6 includes a first receiving element 6*a* and a second receiving element 6*b*. Alternatively, more than two receiving elements may be provided. It is possible that one receiving element has both a positive pole and a negative pole for supplying electrical power. Both first and second receiving elements 6*a*, 6*b* are designed in the form of a contact plate. Alternatively, first and second receiving element 6*a*, 6*b* may also be designed as a cylinder.

Power supply unit 7 designed as a battery essentially includes a housing 9, in which a number of individual, interconnected power storage cells, also referred to as battery cells, are positioned. With the aid of the battery cells, electrical energy may be stored in battery 7.

The battery cells are not illustrated in the figures.

A connecting device 9*a*, which has a first contact element 10*a* and a second contact element 10*b*, is positioned on an upper end of housing 9. Connecting device 9*a* is used for connection to receiving device 6. For this purpose, connecting device 9*a* is inserted into receiving device 6 and held thereby.

Alternatively, more than two contact elements may also be provided. It is possible that one contact element has both a positive pole and a negative pole for supplying electrical power.

First contact element 10*a* is used for detachable connection to first receiving element 6*a*, and second contact element 10*b* is used for detachable connection to second receiving element 6*b* (cf. FIGS. 3 and 4). By connecting first and second contact elements 10*a*, 10*b* to particular first and second receiving elements 6*a*, 6*b*, the electrical energy stored in the battery cells may be conducted from battery 7 to receiving device 6. The electrical energy is subsequently passed on to electrical consumers in power tool 1.

In the specific embodiment which is not illustrated, in which power supply unit 7 is not designed as a battery but as a connecting unit for a power network, the connecting unit also has a first contact element 10*a* and a second contact element 10*b* for the particular connection and establishment of an electrical connection with first and second receiving elements 6*a*, 6*b* of receiving device 6.

An electric motor for generating a torque is positioned in housing 2 of power tool 1. The electric motor is thus an electrical consumer of electrical energy. The torque generated in the electric motor is transmitted to tool holder 3 via an output shaft and a transmission. Tool 8 is rotated with the aid of the transmitted torque. The electric motor, the output shaft and the transmission are not illustrated in the figures.

As illustrated, in particular in FIGS. 3 and 4, first contact element 10*a* includes a first contact plug 11*a*, a first litz wire 12*a* and a first damping element 13*a*. Second contact element 10*b* includes a second contact plug 11*b*, a second litz wire 12*b* and a second damping element 13*b*. First contact plug 10*a* has a first end 14*a* and a second end 15*a*. Second contact plug 11*b* has a first end 14*b* and a second end 15*b*. First litz wire 12*a* is connected to second end 15*a* of first contact plug 10*a*, and second litz wire 12*b* is connected to second end 15*b* of second contact plug 10*b*. Litz wires 12*a*, 12*b* are provided with a flexible design and permit a movement of contact plugs 11*a*, 11*b* in directions A and B. Moreover, litz wires 12*a*, 12*b* are used to transmit the electrical energy from the battery cells to particular contact elements 10*a*, 10*b*.

First contact element 10*a* is furthermore situated in a first contact chamber 16*a*, and second contact element 10*b* is situated in a second contact chamber 16*b*. The two contact chambers 16*a*, 16*b* are essentially designed as bulges for particular contact elements 10*a*, 10*b* and are positioned side by side on an upper end 17 of battery housing 9. Each contact chamber 16*a*, 16*b* designed as a bulge thus has an opening 18*a*, 18*b*, through which contact plugs 11*a*, 11*b* are accessible in contact chambers 16*a*, 16*b*. The two contact plugs 11*a*, 11*b* are situated in particular contact chambers 16*a*, 16*b* in such a way that first end 14*a*, 14*b* of particular contact plug 11*a*, 11*b* faces opening 18*a*, 18*b* of contact chamber 16*a*, 16*b*.

In addition, first contact plug 11*a* includes a first contact blade 19*a* and a second contact blade 19*b*, and second contact plug 11*b* includes a first contact blade 20*a* and a second contact blade 20*b*.

As indicated in FIG. 3, contact blades 19*a*, 19*b*, 20*a*, 20*b* are provided with a movable or flexible design, so that first contact blade 19*a*, 20*a* may be reversibly or elastically pivoted in arrow direction C, and second contact blade 19*b*, 20*b* may be reversibly or elastically pivoted in arrow direction D. The movability of contact blades 19*a*, 19*b*, 20*a*, 20*b* is used to be able to receive particular receiving element 6*a*, 6*b* designed as contact plates, so that each contact plate abuts first and second contact blades 19*a*, 19*b*, 20*a*, 20*b* when battery 7 is properly connected to power tool 1 (cf. FIG. 4).

First and second damping elements 13*a*, 13*b* are designed as springs according to the present exemplary embodiment. Spring 13*a* a first end 21*a* as well as a second end 22*a*, and spring 13*b* a first end 21*b* and a second end 22*b*. Each damping element 13*a*, 13*b* designed as a spring is situated in particular contact chamber 16*a*, 16*b* and in relation to particular contact plug 11*a*, 11*b* in such a way that first end 21*a*, 21*b* of spring 13*a*, 13*b* abuts second end 15*a*, 15*b* of particular contact plug 11*a*, 11*b*. Second end 22*a*, 22*b* of each spring 13*a*, 13*b* abuts a back wall 23, 24 of each contact chamber 16*a*, 16*b*. The spring force of each spring 13*a*, 13*b* thus presses particular contact plug 11*a*, 11*b* in arrow direction A. It should be noted that the length and characteristic of particular litz wires 12*a*, 12*b* are selected in such a way that they may follow the entire spring deflection of springs 13*a*, 13*b*. In other words, litz wires 12*a*, 12*b* are at least long enough that they are not torn off by particular contact plug 11*a*, 11*b* when contact plug 11*a*, 11*b* is moved over the entire distance in direction A.

With the aid of damping elements 13*a*, 13*b* designed as springs, vibration-induced relative movements (e.g. in arrow directions A and B) may be compensated for, which occur between contact element 10*a*, 10*b* and receiving element 6*a*, 6*b* when machine tool 1 is in use.

What is claimed is:

1. A power tool comprising: a receiving device having at least one receiving element; a power supply unit connectable to the power tool and including a connecting device, the connecting device having at least one contact element, the receiving device being designed to receive and hold the connecting device, so that the at least one receiving element and the at least one contact element are connectable to each other to establish an electrical connection; and a damping element on the at least one contact element or the at least one receiving element to counteract a relative movement between the contact element and the respective receiving element when the contact element and the receiving element are connected to each other.

2. The power tool as recited in claim 1 wherein the damping element is designed as a spring and is positioned behind the contact element in a first direction, so that a spring force applied by the spring presses the contact element in a second direction.

3. The power tool as recited in claim 1 wherein the damping element is designed as a component including an elastically deformable material.

4. A power drill comprising the power tool as recited in claim 1.

5. The power tool as recited in claim 1 wherein the power supply unit is a rechargeable battery.

6. The power tool as recited in claim 1 wherein the at least one contact element includes a first contact plug and a first litz wire attached to the first contact plug.

7. The power tool as recited in claim 6 wherein the first contact plug has a first open end for receiving the receiving element and a second closed end, the first litz wire attached to the second closed end.

8. The power tool as recited in claim 6 wherein the first litz wire is flexible to permit a movement of the first contact plug.

9. The power tool as recited in claim 6 wherein the first contact plug is located in a first contact chamber having a first opening, the first contact plug having a first open end facing the first opening.

10. The power tool as recited in claim 1 wherein the at least one contact element includes exactly two contact elements and the at least one receiving element includes exactly two receiving elements.

11. The power tool as recited in claim 1 wherein the at least one contact element includes a first end and a second end and two opposing contact blades between the first and second end.

12. The power tool as recited in claim 11 wherein at least one of the two opposing contact blades is flexible so as to be pivotable about the second end.

13. The power tool as recited in claim 12 wherein both of the two opposing contact blades are flexible so as to be pivotable about the second end.

14. The power tool as recited in claim 11 wherein the two opposing contact blades slope to converge towards each other from the second end to a minimum spacing distance.

15. The power tool as recited in claim 14 wherein the two opposing contact blades diverge away from each other from the minimum spacing distance to the first end.

16. The power tool as recited in claim 14 wherein at least one of the two opposing contact blades is flexible so as to be pivotable about the second end.

17. The power tool as recited in claim 16 wherein both of the two opposing contact blades are flexible so as to be pivotable about the second end.

18. The power tool as recited in claim 1 wherein the at least one receiving element is a contact plate.

19. The power tool as recited in claim 1 wherein the at least one contact element is situated in a contact chamber.

20. The power tool as recited in claim 19 wherein the at least one contact element includes a first end and a second end and two opposing contact blades between the first and second end, the two opposing contact blades being pivotable within the contact chamber.

* * * * *